United States Patent [19]

Williams

[11] 4,039,778

[45] Aug. 2, 1977

[54] ELECTRIC CARTRIDGE HEATER WITH A MULTIPLE THERMOCOUPLE ASSEMBLY

[75] Inventor: David E. Williams, Hemet, Calif.

[73] Assignee: Rama Corporation, San Jacinto, Calif.

[21] Appl. No.: 701,526

[22] Filed: July 1, 1976

[51] Int. Cl.[2] ..... H05B 3/40

[52] U.S. Cl. ..... 219/544; 13/22; 73/341; 136/233; 219/328; 219/471; 219/494; 219/510; 219/530; 219/534; 219/541; 338/238

[58] Field of Search ..... 219/328, 469, 470, 471, 219/494, 505, 510, 523, 530, 534, 535, 541, 544, 552, 553; 338/238; 29/615; 423/509; 13/20, 22, 24, 25; 73/341; 136/200, 201, 204, 230, 231, 232, 233

[56] References Cited

U.S. PATENT DOCUMENTS

| | | | |
|---|---|---|---|
| 3,129,056 | 4/1964 | Muir | 423/509 |
| 3,229,358 | 1/1966 | Scadron et al. | 29/615 |
| 3,286,081 | 11/1966 | Scowcroft | 219/470 |
| 3,338,752 | 8/1967 | Finney | 136/233 |
| 3,340,382 | 9/1967 | Lennox | 219/544 |
| 3,414,711 | 12/1968 | Guyet et al. | 219/469 |
| 3,476,916 | 11/1969 | LaVan | 219/552 |
| 3,492,170 | 1/1970 | Davis et al. | 136/233 |
| 3,607,447 | 9/1971 | Davis et al. | 136/233 |
| 3,614,387 | 10/1971 | Wrol et al. | 219/328 |
| 3,898,431 | 8/1975 | House et al. | 219/534 |

*Primary Examiner*—Volodymyr Y. Mayewsky
*Attorney, Agent, or Firm*—Georges A. Maxwell

[57] ABSTRACT

A cartridge heater and multiple thermocouple assembly comprising an elongate outer heavy walled structurally supportive metal sheath, an elongate thin walled, yieldable, orienting metal tube extending through the sheath and defining an annulus, a plurality of axially aligned pairs of thermocouple cables and spacer rods fixed to the tube in circumferential spaced parallel relationship and extending through the annulus in interfering engagement with the sheath, a resistance element extending through the tube, conductor terminals for the element accessible at one end of the tube and a filler of particulate dielectric material compacted in the tube about the element and in the annulus between the sheath, tube and adjacent pairs of cables and rods, said cables being of different lengths and having outer ends with conductors accessible at an end of the annulus and having inner ends with thermocouple junctions located at spaced points longitudinally of the sheath.

18 Claims, 8 Drawing Figures

ELECTRIC CARTRIDGE HEATER WITH A MULTIPLE THERMOCOUPLE ASSEMBLY

Throughout the arts, elongate metal jacketed electric resistance heater units, oftentimes referred to as cartridge heaters, are commonly provided and employed to heat related structures, fluid mediums and the like.

The ordinary and most common form of cartridge or metal jacketed heater unit of the character here concerned with comprises an elongate tubular metal jacket with open ends, an elongate electric resistance element arranged concentric within and extending longitudinally of the jacket, a body of granular dielectric insulating material in the sheath and about the element to support and maintain the element in predetermined, desired, spaced relationship within the sheath. The heater structures or units further include closure means at the ends of and closing of the sheaths and over connecting or terminal means for the elements extending through the closure means and accessible at the exterior of the units.

In practice, after the various parts of the above type of heater units are related within each other in the manner set forth above, the sheaths are commonly swaged radially inwardly throughout the longitudinal extent of the units to tightly compact the filler in and about the sheaths and elements and so as to reduce the outside diameter of the units to predetermine finished size or gauge.

In practice, it is not infrequent that heater units of the character referred to above are provided with one or a multiplicity of longitudinally extending resistance elements extending throughout predetermined limited portions of the units to be selectively energized so as to control the heat generating characteristics of the units.

In many instances it is desirable or necessary that the temperature of the units, particularly the sheaths thereof, be monitored in order to assure the delivery of heat to related work within allowable parameters and/or to enable effective and desired control of the units. Still further, it is oftentimes necessary or desired that the temperature of the sheaths of such heater units be monitored at various stations or locations spaced throughout the longitudinal extent of the units.

To the above end, it has become common practice to provide cartridge type heater units of the character referred to above with one or a plurality of thermocouples having junctions suitably fixed to and in operably effective juxtaposition with the heater sheaths. The thermocouple junctions are commonly at the ends of elongate cables comprising outside metallic tubes and insulated conductors extending through the tubes. The thermocouple cables are arranged to extend longitudinally of the sheaths, with their junction ends at predetermined locations between the ends of the sheaths and with their other ends or end portions projecting from an end of the unit so as to provide free access to the conductors which normally extend therefrom.

While the above basic combination and relationship of sheaths and thermocouples may appear to be simple, straightforward and unlikely to present any particular problems in its establishment, it has been found that in practice, safe, dependable and effective relating of such thermocouples to such heater sheaths presents a multitude of problems, many of which are not easily overcome.

For example, there are few instances where such thermocouples can be safely and effectively related and fixed to the exterior of related heater sheaths. In those instances where such a relationship of parts might be acceptable, it is seldom if ever as desirable as that relationship of parts wherein the thermocouples are related to the interiors of the sheaths to be protected thereby and so that the thermocouples do not present undesirable and interfering protuberances about the exterior of the heater units.

The prior art has taught the milling of grooves in the exterior of heater unit sheaths to accommodate thermocouple cables, whereby the thermocouples are substantially shrouded or protected from damage and where principal or major contact of the thermocouple junctions is with the sheath. While such structures are functionally superior to simply fixing the thermocouples to the exterior of the sheaths, they have proven to be less than desirable or satisfactory since the milling and establishment of grooves in the exteriors of the sheaths adversely affect the structural integrity of the sheaths and adversely affect the heat conducting characteristics of the resulting heater units.

Further, the establishment or milling of such grooves is a time consuming and costly operation and requires the employment of thick walled, costly and difficult to swage sheathing stock in order that the sheaths have sufficient stock in which the desired grooves can be established.

Another structure provided by the prior art comprises arranging the thermocouple cables and junctions in predetermined relationship about the exterior of sheaths of their related heater units and subsequently engaging a thin walled metal cover or jacket about the assembly, which jacket is provided with preformed radially inwardly opening longitudinal grooves to accommodate the cables. This structure has proved to be wanting in that it adversely alters the exterior configuration and/or dimensions of the heater unit. Further, air gaps are unavoidably established in, about and between the cables, sheaths and jackets, which air gaps adversely affect the heat conducting characteristics of the resulting heater unit.

Still further, as a result of heating and cooling of the parts of such structures, the parts expand and contract at different rates and to varying extent with the result that the parts of the assembly are subject to relative working and/or displacement.

In some circumstances, and under a limited number of conditions, the prior art has found it possible to fix the junction ends of thermocoupled cables to the inside surfaces of cartridge heater sheaths prior to the assembly and swaging of the heater units or assemblies. Such practice is practically limited to heater structures having extraordinary large diameter sheaths which afford appropriate inner working space to effect necessary work to be performed and to heater structures having but one or a varying limited number of thermocouples related thereto. A principal shortcoming in such structures has been the tendency for the means employed to secure the thermocouples to the inner surfaces of the sheaths to fail or separate during assembly and/or swaging of the structure and/or upon heating and cooling of the finished heater units.

To the best of our knowledge and belief, the most effective and practical prior art means for positioning and holding a plurality of thermocouple cables with their junction ends in engagement with the inside surfaces of related heater unit sheaths is disclosed in FIGS. 1 and 2 of U.S. Pat. No. 3,898,431 issued Aug. 5, 1975, to R. Kingsly House and David E. Williams, for "TUBULAR ELECTRIC HEATERS WITH A THERMOCOUPLE ASSEMBLY."

The above referred to structure is similar to a conventional heater structure and is further provided with an inner, thin walled, orienting tube which is preformed with a plurality of circumferentially spaced longitudinally extending and radially outwardly opening channels to accommodate and carry the thermocouple cables and which is slidably engageable in the sheath with which it is related, before swaging of the heater structure. The heating element and the dielectric filler of this form of heater construction are arranged and deposited in the inner tube and the assembly is swaged in accordance with normal practice. The thermocouple cables are of varying length and extend along a limited portion of their related grooves. The remaining portions of the grooves accommodate spacer rods which are similar in cross-section with the cables. The rods support their adjacent portions of the sheath and tube in the same manner that the cables support their adjacent portions of the sheath and tube, whereby the structures will deform or be reformed substantially uniformly throughout their longitudinal extent when they are swaged in or during the course of manufacture of the heater units.

The principal shortcomings to be found in the last noted prior art structure resides in the fact that insulative air spaces are established between and about the sheaths, portions of the tubes and about the cables related thereto. Such air spaces adversely affect and prevent unform heat conduction in and throughout the structures.

In an effort to overcome such adverse effects, the grooves in the tubes, about the cables and/or rods, have been filled with suitable metal filler, such as metal wire roving. Such efforts, while eliminating the problem created by insulative air gaps, create, in effect, an opposite problem of equal significance since the added metal masses establish by the fillers act as heat sinks, which impart uneven heat conducting characteristics into the heater structures.

Additionally, the preforming of grooves in the tubes is costly and the number of grooves that can be effectively formed in such tubes is quite limited. Accordingly, the number of thermocouples that can be provided in such structures is materially limited and is dictated by the number of grooves that can be formed in the tubes. Finally, in the last noted prior art structure, the inside cross-section of the tubes and resulting cross-section of the dielectric filler deposited therein are of irregular shape and such that upon final swaging of the heater structures, the noted filler is not compacted uniformly and tends to move within the tube, upon swaging, in a manner more likely to result in misalignment or distortion of the heating elements.

An object and feature of our invention is to provide a novel heater structure of the general character referred to and including a multiple thermocouple assembly, which structure is better suited for mass production and which is easier and more economical to make than are those heater structures with multiple thermocouple assemblies provided by the prior art.

It is another object and feature of the present invention to provide a structure of the character referred to which is such that a materially greater number of thermocouples can be easily and effectively provided than is possible or practical in structures of a similar type or class provided by the prior art.

Yet another object of our invention is to provide a novel heater structure which affords greater uniformity of heat conduction than do prior art structures of the same class.

Still another object and feature of our invention is to provide a multiple thermocouple assembly adapted to be arranged within the sheath and about the resistance element of a related cartridge type heater unit and including a thin walled resilient and/or readily deformable tube and a plurality of elongate thermocouple cables and axially aligned spacer rods arranged in circumferentially spaced relationship about and extending longitudinally of the tube.

It is another object and feature of our invention to provide a structure of the character referred to above wherein the radial extent of the annulus between the tube and its related sheath is less than the diametric extent of the thermocouple cables and spacer rods, whereby the substantially uniform, heat conducting, metal to metal interfering fit is established with and between the tube, cables, rods and sheath upon assembly of the parts and after the structure is swaged.

It is another object and feature of our invention is to provide a structure of the general character referred to above wherein the portions of the annulus between the tube and sheath and between adjacent thermocouple cables and rods, and wherein the interior of the tube are occupied by granular dielectric filler material, which material is compacted by swaging of the structure and provides orienting support for the heater element extending through the tube, radial support between the sheath and tube for transmitting radially inwardly directed tube swaging and compacting forces to the filler within the tube when the sheath is swaged radially inwardly and which provides for circumferential orienting support for the cables and rods and affords uniform heat conduction through the annulus between the tube and sheath.

The foregoing and other objects and features of our invention will be apparent and will be fully understood from the following detailed description of typical preferred forms and applications of our invention, throughout which description reference is made to the accompanying drawings, in which.

Figures 1, 2, 3, 4, 5, 6, 7, 8:
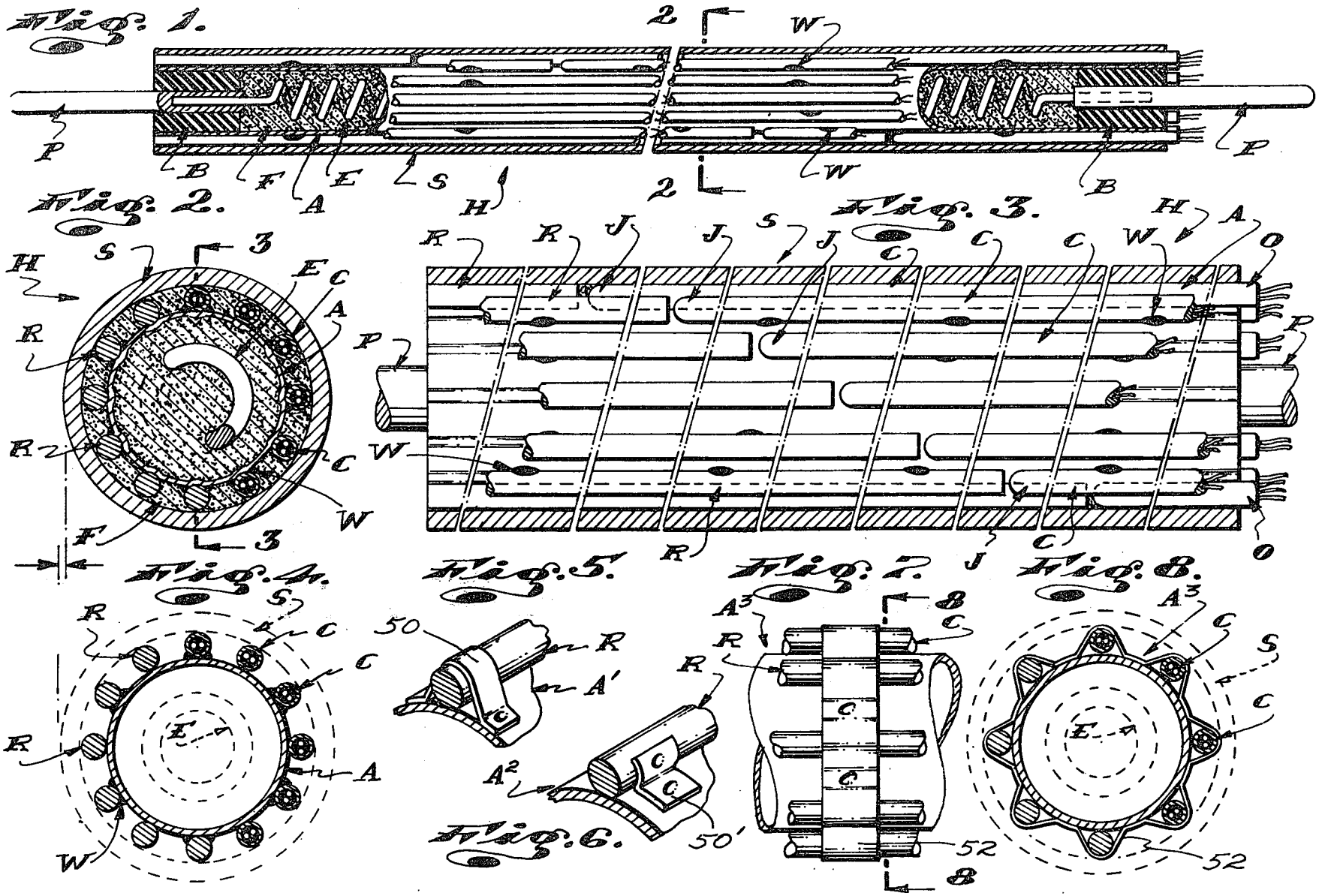
FIG. 1 is a longitudinal partial sectional view with portions broken away to better illustrate details of the construction.
FIG. 2 is an enlarged sectional view taken substantially by line 2—2 on FIG. 1.
FIG. 3 is a sectional view taken as indicated by line 3—3 on FIG. 2.
FIG. 4 is a transverse sectional view of a portion of our structure.
FIG. 5 and FIG. 6 are isometric views showing portions of modified forms of our invention.
FIG. 7 is a view of a portion of another form of the invention.
FIG. 8 is a view taken substantially as indicated by line 8—8 on FIG. 7.

The present invention has to do with an elongate cartridge type heater unit H, which unit includes an elongate outer metal sheath S, an elongate resistance wire or heating element E extending longitudinally through the sheath, substantially concentric and in radial spaced or clear relationship therewith. The unit H next includes a filler F of compacted granular dielectric material within the sheath and about the element E to support and maintain the element in proper spaced relationship within the sheath.

The element E can, as shown, be a helically wound length of resistance wire. In practice, the element E can be in any one of a number of common forms. For example, it can be a straight length of wire, rod or ribbon stock of desired resistive material, without departing from the spirit of our invention.

Further, and in accordance with common practice, the heater unit H can be provided with two or more elements E suitably arranged, in longitudinal and/or radial spaced relationship within the filler F, within the sheath S. Since the practice of providing heater units with multiple heating elements and the structures employed in that practice is old and well known in the art, and since illustrating and describing such structures would only serve to unduly burden this disclosure and cloud the invention, we have elected to restrict this disclosure to a unit having but one element E.

In accordance with common practice the unit H includes a pair of terminals T related to the opposite ends of the element E to facilitate connecting the unit or element E in and/or with a suitable power circuit (not shown). The terminals T can be extensions of the element E which project from and are accessible at one or opposite ends of the sheath S, or can be, as shown, sturdy contact posts or pins suitably fixed to related ends of the element E, within the sheath and projecting freely from one or, as shown, opposite ends of the sheath S.

In practice, the ends of the tubular sheaths of the heater units of the class herein concerned with are closed and sealed by elongate cylindrical plug-like closure means B, through which the ends of the elements E or the terminals T extend and which serve to contain the filler F, orient the means P and/or element E and which hermetically seal the ends of the units. The plugs B can be unitary plugs of lava assemblies of mica discs, or the like.

In carrying out and/or putting our invention into practice, the form closure means B which is provided at the ends of the sheath can vary considerably without departing from the spirit of or adversely affecting the instant invention.

The structure thus far described is that basic structure which characterizes the ordinary cartridge type resistance heater unit and which is old in the art.

In accordance with the foregoing and in accordance with the instant invention, we provide a multiple thermocouple assembly A, which assembly includes an elongate orienting tube T, a plurality of elongate thermocouple cables C with inner junction ends J and outer free end portions O and a plurality of elongate spacer rods R.

The tube T that we provide is substantially equal to or slightly less in longitudinal extent than the sheath S and is smaller in diameter than the inside diameter of the sheath S. The tube T is substantially greater in inside diameter than the diametric extent of the element E or element assembly, whichever the case might be.

The metallurgical makeup and the wall thickness of the sheath is such that the sheath is a heavy, strong part which affords the finished unit with necessary and desired structural rigidity and support and is such that when worked upon and swaged radially inwardly to compact the filler F within the structure, it retains its full integrity and is such that it will set and retain that configuration to which it is worked and will effectively resist deformation by any and all anticipated internal and external forces subsequently applied to the heater structure and which might otherwise alter, deform and/or upset the configuration of the heater unit.

In a heater unit which is about 0.480 inches in diameter, the sheath S is preferably established of Inconel or Incaloy stainless steel and has a wall thickness of about 0.025 to 0.049 inches.

The metallurgical makeup of the tube T need not be the same as that of the sheath and the wall thickness of the tube is preferably substantially less than that of the sheath. The primary purpose and/or function of the tube is to carry, support and orient the cables C and rods R within the sheath and within the filler F of the construction without adversely affecting or preventing the radial inward swaging and forming of the sheath, radial inward displacement of the cables and rods during swaging, and without adversely affecting or preventing the uniform radial inward and longitudinal compaction of the filler F within the construction, during the assembly and swaging of the construction.

To the above end, the wall thickness of the tube is substantially less than the wall thickness of the sheath to impart desired flexibility and/or malleability thereto and can, for example, be about 0.010 inches thick, as compared to the sheath which is, as above noted, 0.025 to 0.049 inches thick.

The outside radial extent of the tube T is preferably less than the inside radial extent of the sheath S by a distance substantially equal to or slightly less than the diametric extent of the cables C and/or rods R, whereby the radial extent of the annulus between the tube and the sheath, when the two are arranged concentrically, is such that rods and cables arranged therein establish interferring sliding fit with and between the tube and sheath. The interferring fit thus established is such that the rods and cables establish positive, uniform, metal to metal, heat conducting contact with both the sheath and the tube and the contact thus established is such that the migration and/or movement of filler material between the rods and cables and their adjacent surfaces of the sheath and tube cannot normally occur.

In practice, the tube T can be made sufficiently thin and can be imparted with sufficient predetermined resiliency so that the force or pressure of the interferring fit between the sheath, tube and intermediate rods and cables, is predetermined.

In practice, for example, if the rods and cables are 0.067 inches in diameter, the outside diameter of the tube T is 0.067 inches less than the inside diameter of the sheath, whereby the annulus between the sheath and tube is 0.067 inches and such that the rods and cables are closely engageable therebetween.

In practice, due to inherent irregularities in the dimensions and surface characteristics of the parts, when the above noted relationship is provided, a suitable interferring fit oftentimes will result.

In practice, carrying the above example forward, and to assure a desirable and effective interferring fit, the outside diameter of the tube can be made 0.001 inches larger in diameter and such that when the parts are arranged and assembled, the tube T yields radially inwardly 0.001 inches adjacent each rod and cable and yieldingly urges the rods and cables into yielding pressure engagement with the tube and the sheath with that force which is required to cause such yielding of the tube.

The thermocouple cables C are less in longitudinal extent than the tube T and sheath S and are arranged parallel and adjacent the exterior surface of the tube T with their junction ends J at different predetermined positions longitudinally of the tube and with their other or outer end portions projecting axially outwardly from an end of the tube T.

The rods R are equal in cross-sectional configuration and/or diameter with the cables C and in practice, can be established of lengths of the same cable which is employed to establish the thermocouples, whereby the rods and cables would have the same structural characteristics. The rods R are arranged in axial alignment with related cables C with inner ends spaced a short or limited distance from the junction ends J of the cables and extending longitudinally to the other or remote ends of the tube T.

The rods R and cables C are temporarily fixed or secured to the exterior of the tube T at longitudinally spaced points and in predetermined circumferential and longitudinal spaced relationship relative to the tube and to each other, whereby a sub-assembly A comprising the tube, rods and cables is established. The assembly A can be effectively slidably engaged in a related sheath without displacement of the rods and cables.

In the preferred carrying out of our invention, the rods R and cables C are arranged in desired position about the tube T, are fixed to the tube T so as to establish a sub-assembly which can be effectively handled and manipulated to effect its engagement within the related sheath, without displacement of the rods and cables. As shown in FIGS. 1 through 4 of the drawings, the rods R and cables C are tacked to the tube T by spot-welds W at longitudinally spaced points throughout their longitudinal extent.

In practice, the spot-welds are established between the tube and the rods and cables through an intermediate material such as a nickel-chrome alloy. This alloy material can be presented between the related parts in the form of small chips of shim stock preparatory to welding.

In practice, numerous other means can be employed to hold the parts of the noted sub-assembly A in proper position. For example, U-shaped straps 50 of thin shim stock can be engaged over the rods R and cables C and spot-welded to the tube T, as shown in FIG. 5 of the drawings. Alternatively, small tabs 50' established of similar shim stock, can be first spot-welded to the rods R and to the cables C and then spot-welded to the tube T as shown in FIG. 6 of the drawings.

Still further, if necessary or desired, the rods R and cables C can be oriented and held in position about the tube T by suitably formed longitudinally spaced retaining bands 52 of suitable thin shim stock, which bands can be spot-welded to the tube, if desired of circumstances require, and as clearly illustrated in FIGS. 7 and 8 of the drawings.

In practice, there is provided a sufficient number of circumferentially spaced rods, cables or aligned rods and cables, in the annulus between the tube and sheath to orient and maintain tube T concentric in and with the sheath.

In furtherance of the foregoing, the minimum practical number and placement of circumferentially spaced rods and cables is three rods and/or cables, spaced 120° apart and substantially coextensive with the longitudinal extent of the tube.

In such an arrangement, a single thermocouple with a related continuing or extending rod section and two rods can be provided. Alternatively, two thermocouples with continuing rod sections and one rod, or, three thermocouples with related continuing rod sections can be provided, as desired or as circumstances require.

The maximum number of thermocouples that can be provided by our invention is limited by the circumferential extent of the annulus between the tube and sheath and the number of thermocouple cables and/or rods that can be arranged therein in side by side relationship.

It will be apparent that in practice, the junction ends J of the thermocouples, to be effective, must terminate at a point between and spaced from the ends of the sheath and tube assembly and that each thermocouple is therefore associated with an extension or continuation rod R which is of sufficient longitudinal extent to extend from near proximity to the junction end of its related thermocouple cable, to the free, related end of the tube T and so that the aligned or related cables and rods afford lineal contact and support for and between the sheath and the tube throughout the longitudinal extent of said and tube, as shown in the drawings.

In carrying out our invention, after the sub-assembly comprising the tube, sheath, cables and rods and assembled and the element E is positioned in the confines of the tube, the interior of the construction, that is, the interior of the tube and the annulus between the tube and the sheath is filled with the granular filler F of dielectric material (such as magnesium oxide) and that material is caused to settle uniformly in and throughout the construction as by vibrating the assembly during the filling operation. The filler F at this stage of construction so completely fills and occupies the interior of the construction to effectively hold and support all of the parts in position and such that the particles or granules of the material are in sufficiently intimate and uniform contact that the filler is an effective force transmitting bridging structure.

It is to be understood that prior to filling the structure with filler F and when orienting the element E in the tube T, one end of the tube is closed with and by its related plug B.

Subsequent to filling the structure with filler F, as noted above, the plug B related to the other ends of the tube T and sheath S is engaged with the parts of the construction with which it is related.

As shown in FIG. 1 of the drawings, the tube T is shorter than the sheath S and is arranged in the sheath with its ends spaced inwardly from the ends of the sheath. The plugs B are formed with enlarged outer end portions which extend radially outwardly from the ends of the tube and seal in the adjacent end portions of the sheath, to close the ends of the sheath.

In practice, the manner in which the ends of the sheath or the annulus between the sheath and tube are sealed can vary widely without departing from the spirit of our invention. Sealing of the ends of the sheath by the plugs B, as shown and described above, is only illustrative of one typical manner and means that can be employed and which will suffice.

Subsequent to filling and plugging or sealing the structure or assembly, as noted above, the assembly is finished by swaging the assembly radially inwardly and progressively from one end thereof to the other, whereby the exterior of the sheath is reduced in diameter to desired gauge and the filler F in the construction, in both the annulus and in the tube, is compacted into a substantially solid, tight, uniform mass.

It is significant and important to note that the uniform linear contact of the rods R and cables C with the sheath S and tube T is sufficiently tight so that the filler is not subject to migrating between and interrupting the desired metal to metal contact of the parts prior to swaging of the construction.

Further, the filler F in the annulus between the sheath S and tube T intermediate the cables C and rods R is sufficiently dense and affords a sufficiently strong force transmitting bridging mass in the annulus to support the portions of the sheath between the rods and the cables and to prevent those portions of the sheath from being deformed radially inwardly to any appreciable greater extent than are the portions of the sheath adjacent the rods and cables, when the structure is swaged radially inwardly.

The tube T, as noted before and as shown in the drawings, is materially thinner than the sheath and, while sufficiently heavy and strong to support the rods R and cables C, is sufficiently malleable and/or flexible so that upon swaging of the structure radially inwardly, the tube T yields radially inwardly under the swaging forces conducted to and through it by the filler, cables and rods and effects desired compaction of the filler F within the tube T and about the element E.

In practice, upon engaging the sub-assembly A in the sheath S, and upon swaging the construction, the tube T yields and/or is deformed radially inwardly to a slightly greater extent along the lines of the rods and cables than it is between those lines (see FIG. 2 of the drawings) and is not uniform or round in cross-section, as is the sheath S. Such lack of uniformity within the structure affords no appreciable adverse effects and is a result of the distribution of those forces in and through the structure which results in uniform compaction of the filler and the accurate orientation and contacting of the parts of the construction.

In practice, during swaging of the construction and the relative movement or shifting of parts which takes place, the welds W which serve to maintain the sub-assembly A as a unit may fail. Such failure of the welds affords no adverse effects and may in fact be anticipated, if not sought, by making the welds W no larger or extensive than is required to effect assembly of the parts.

Since the thermocouple cables are oftentimes extremely small and fragile, welds which would be of a certain and permanent nature would tend to weaken and damage the cables. Since the welds W employed in carrying our invention need not be permanent, but can in fact be of a temporary nature, suitable welding of the cables in place can be effected with small or limited welds which are not likely to damage the cables.

In the heater unit H that we provide, the annulus between the tube T and sheath S and which is occupied by the cables C, rods R and filler F, is free of heat insulating air gaps which would adversely affect the heat conducting characteristics of the sheath and which is characteristic in heaters of the similar class provided by the prior art.

The tube T within the sheath S is spaced free and uniformly from and about the heater element E and is separated therefrom by the uniform mass of filler F within the tube. As a result, the tube T is heated uniformly and is such that it conducts heat to the rods R and cables C in contact therewith, uniformly. The heat conducting characteristics through the rods and cables and between the tube and sheath are substantially uniform and the conduction of heat from the tube T to the sheath S, through the filler F in the annulus, is substantially uniform. As a result of the above, the heater structure here provided is possessed with known, predetermined, uniform heat conducting characteristics and, as such, is particularly suited for use in those situations where heaters of the type and/or class here concerned with, having known and uniform operating characteristics, are required.

It is important to note that the heater unit H that we provide is free of costly, complicated and/or difficult to make and assemble parts and is such that it readily lends itself to being manufactured easily, quickly and economically with the exercise of the most common and economical to use heater manufacturing procedures and techniques.

Having described only typical preferred forms and applications of our invention, we do not wish to be limited to the specific details herein set forth but wish to reserve to ourselves any modifications and/or variations that may appear to those skilled in the art and which fall within the scope of the following claims:

Having described our invention, we claim:

1. An elongate cartridge heater and thermocouple unit comprising an elongate normally cylindrical outer tubular metal sheath with open ends, an elongate normally cylindrical inner tubular metal tube with open ends concentric with and extending freely through the sheath in spaced parallel relationship therewith and defining an annulus, a plurality of axially aligned pairs of normally cylindrical thermocouple cables and spacer rods fixed to the exterior of the tube in circumferential spaced parallel relationship therewith and extending longitudinally through the annulus in interfering engagement with the sheath, plugs at and closing the ends of the tube and the sheath, an elongate resistance element substantially concentric with and extending longitudinally through the tube in spaced parallel relationship therewith and between the plugs, elongate conductor terminals at the ends of the element and each extending axially outwardly through and from a related plug and a filler of particulate dielectric material compacted in the tube about the element and in the annulus between the pairs of cables and rods, sheath, tube and plugs, the cables having outer end portions with thermocouple conductors accessible at free outer ends thereof extending axially through and from the plug at a related end of the annulus and having inner ends with thermocouple junctions, said cables being of different longitudinal extent and positioned with their junctions in contact with the sheath at spaced points longitudinally thereof, said rods being of different longitudinal extent and each having an inner end in close proximity with the junction of its related cable and an outer end terminating in close proximity with a related end of the annulus, said sheath being a strong substantially rigid supporting part, said tube being a relatively weak yieldable part orienting the cables and rods in the sheath.

2. The unit set forth in claim 1 wherein the rods and the cables are fixed to the tube by longitudinally spaced welds.

3. The unit set forth in claim 1 wherein the rods and the cables are fixed to the tube by longitudinally spaced retaining straps engaging the rods and cables and welded to the tube.

4. The unit set forth in claim 1 wherein the rods and cables are fixed to the tube by longitudinally spaced U-shaped straps embracing the rods and having ends welded to the tube.

5. The unit set forth in claim 1 wherein the rods and cables are fixed to the tube by longitudinally spaced elongate straps with opposite ends welded to the tube and with the related rods and cables.

6. The unit set forth in claim 1 wherein the rods and cables are fixed to the tube by longitudinally spaced bands engaged about the tube and having formed portions embracing their related rods and cables.

7. The unit set forth in claim 1 wherein the portions of the tube adjacent the pairs of rods and cables are deformed radially inwardly and are biased into pressure engagement with the rods and cables and urging the rods and cables radially outwardly into pressure engagement with the sheath.

8. The unit set forth in claim 7 wherein the rods and the cables are fixed to the tube by longitudinally spaced welds.

9. The unit set forth in claim 7 wherein the rods and the cables are fixed to the tube by longitudinally spaced retaining straps engaging the rods and cables and welded to the tube.

10. The unit set forth in claim 7 wherein the rods and cables are fixed to the tube by longitudinally spaced U-shaped straps embracing the rods and having ends welded to the tube.

11. The unit set forth in claim 7 wherein the rods and cables are fixed to the tube by longitudinally spaced elongate straps with opposite ends welded to the tube and with the related rods and cables.

12. The unit set forth in claim 7 wherein the rods and cables are fixed to the tube by longitudinally spaced bands engaged about the tube and having formed portions embracing their related rods and cables.

13. The unit set forth in claim 1 wherein the sheath is swaged radially inwardly and longitudinally throughout its longitudinal extent whereby the filler in the annulus is compacted, the rods and cables are displaced radially inwardly, the portions of the tube adjacent the rods and cables are deformed radially inwardly, the portions of the tube between the tubes and cables are displaced radially inwardly, whereby the filler in the tube and about the element is compacted.

14. The unit set forth in claim 13 wherein the rods and the cables are fixed to the tube by longitudinally spaced welds.

15. The unit set forth in claim 13 wherein the rods and the cables are fixed to the tube by longitudinally spaced retaining straps engaging the rods and cables and welded to the tube.

16. The unit set forth in claim 13 wherein the rods and cables are fixed to the tube by longitudinally spaced U-shaped straps embracing the rods and having ends welded to the tube.

17. The unit set forth in claim 13 wherein the rods and cables are fixed to the tube by longitudinally spaced elongate straps with opposite ends welded to the tube and with the related rods and cables.

18. The unit set forth in claim 13 wherein the rods and cables are fixed to the tube by longitudinally spaced bands engaged about the tube and having formed portions embracing their related rods and cables.

* * * * *